US006694780B2

(12) United States Patent
Watanabe et al.

(10) Patent No.: US 6,694,780 B2
(45) Date of Patent: Feb. 24, 2004

(54) NEEDLE SELECTOR FOR KNITTING MACHINE, AND NEEDLE SELECTING MODULE FINGER

(75) Inventors: Kazuhisa Watanabe, Saitama (JP); Nobuo Iida, Saitama (JP)

(73) Assignees: WAC Data Service Kabushiki Kaisha, Fujimi (JP); Nihon Balluff Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/311,076

(22) PCT Filed: Apr. 11, 2002

(86) PCT No.: PCT/JP02/03605

§ 371 (c)(1),
(2), (4) Date: Dec. 12, 2002

(87) PCT Pub. No.: WO02/086216

PCT Pub. Date: Oct. 31, 2002

(65) Prior Publication Data

US 2003/0164008 A1 Sep. 4, 2003

(30) Foreign Application Priority Data

Apr. 16, 2001 (JP) ..... 2001-117394

(51) Int. Cl.[7] ..... D04B 15/78
(52) U.S. Cl. ..... 66/218
(58) Field of Search ..... 66/215, 218, 216, 66/219, 220, 221

(56) References Cited

U.S. PATENT DOCUMENTS

| | | | | | |
|---|---|---|---|---|---|
| 4,790,154 | A | * | 12/1988 | Lonati | 66/221 |
| 5,027,619 | A | * | 7/1991 | Saito | 66/218 |
| 5,823,015 | A | * | 10/1998 | Shibata | 66/218 |
| 6,220,062 | B1 | * | 4/2001 | Enomoto et al. | 66/218 |
| 6,526,784 | B2 | * | 3/2003 | Machida et al. | 66/218 |

FOREIGN PATENT DOCUMENTS

| | | |
|---|---|---|
| JP | 2-13509 Y2 | 4/1990 |
| JP | 8-109554 A | 4/1996 |
| JP | 2000-73262 A | 3/2000 |

* cited by examiner

*Primary Examiner*—Danny Worrell
(74) *Attorney, Agent, or Firm*—Frishauf, Holtz, Goodman & Chick, P.C.

(57) ABSTRACT

A needle selection module finger (30) is comprised of a finger member (31) and a finger holding member (40). The finger member (31) has a butt abutting portion (33) and a support (34). The support (34) has projections (35, 36) at its lower part. The finger holding member (40) has, from its one end toward the other end, a connecting portion (41) having concave parts (42, 42*a*) for accommodating the projections (35, 36) at the lower part of the support (34), a finger pivot support (43), and a piezoelectric body engaging portion (45). The finger member (31) and finger holding member (40) are positioned by inserting the projections (35, 36) of the finger member (31) in the concave parts (42, 42*a*) of the finger holding member (40), and are integrally connected to each other by inserting a pin 50 in holes (37, 37*a*) formed in the projection (35) and a connecting portion (41).

8 Claims, 8 Drawing Sheets

NEEDLE SELECTOR FOR KNITTING MACHINE, AND NEEDLE SELECTING MODULE FINGER

This application is a U.S. National Phase Application under 35 USC 371 of International Application PCT/JP02/03605 filed Apr. 11, 2002.

TECHNICAL FIELD

The present invention relates to a needle selector for a knitting machine and, more particularly, to a needle selection finger formed by combining a plurality of members, and a needle selector for a knitting machine which uses it.

BACKGROUND ART

In a knitting machine such as a circular knitting machine or weft knitting machine, vertical motions of the working needle are selected on the basis of a knitting procedure stored in a storage such as a floppy disk, to knit a fabric of a desired knit texture. Various types of needle selectors are used for selecting the vertical motions of the working needle.

Before describing the needle selector according to the present invention, the outline of needle selection in a knitting machine will be explained with reference to a circular knitting machine schematically illustrated in FIGS. 4A to 4C.

FIG. 4A is a schematic perspective view for explaining the basic knitting mechanism of a circular knitting machine. As illustrated in FIG. 4A, the circular knitting machine has a knitting cylinder 1 rotatable in the direction indicated by an arrow A. A plurality of vertical grooves (not shown) are formed in the outer surface of the knitting cylinder 1 along its longitudinal axis. Working needles 2 are arranged slidably in the vertical grooves. Usually, needle selection jacks 12 are arranged under the working needles 2 to be able to abut against the lower parts of the working needles 2. A cylinder-shaped cam base 15*a* is stationarily arranged under the knitting cylinder 1. A plurality of raising cams 15 with predetermined shapes are arranged on the upper part of the cam base 15*a* at predetermined intervals.

The basic principle of knitting will be briefly described. When each working needle 2 on the rotating knitting cylinder 1 is thrust upward by the corresponding raising cam 15 through the needle selection jack 12, it projects from the upper surface of the knitting cylinder 1. A yarn 5 fed from a yarn bobbin 6 is supplied to the hook of the projecting working needle 2, thus forming a yarn loop. Then, the working needle 2 is lowered by a known mechanism (not shown), so one stitch is formed. Therefore, control operation of forming a stitch by selecting whether vertical motion is to be applied to the working needle 2, or allowing advance to the next knitting step without forming a stitch can be performed. As a result, a desired fabric can be knitted. In order to provide such motions to the working needles, in the knitting machine, the needle selection jacks 12 are usually arranged in contact with the lower parts of the working needles 2. The vertical motions of the working needles are controlled, by selectively engaging the needle selection jacks 12 and raising cams 15, by using a needle selector 3, operating on the basis of information from a controller 4 with a built-in storage that stores a knitting procedure.

Next, a case wherein piezoelectric bodies are used as needle selection means will be described with reference to FIGS. 4B and 4C which show the relationship among the working needles 2, needle selection jacks 12, and needle selector 3. FIGS. 4B and 4C are schematic views that facilitate understanding of the operation of the needle selection means with ease.

A piezoelectric body 7 can be either curved as shown in FIG. 4B, or curved as shown in FIG. 4C, in the direction opposite to that shown in FIG. 4B, depending on how a voltage is applied to it. A finger 9 is arranged at the tip of the piezoelectric body 7 to be linked to it. In FIGS. 4B and 4C, the piezoelectric body 7, finger 9, and raising cam 15 are positioned within the surface of the drawing, and the working needle 2 and needle selection jack 12 move circularly together with the knitting cylinder 1 (not shown) from the top to the bottom of the surface of the drawing (or in the reverse direction). The needle selection jack 12 can swing about a fulcrum 12*a* as the center. A needle selection butt 13 (upper part) and raising cam butt 14 (lower part) project sideways from the needle selection jack 12 as shown in FIGS. 4B and 4C.

When the piezoelectric body 7 is curved as shown in FIG. 4B, the needle selection butt 13 of the needle selection jack 12 which moves circularly hits the finger 9. As a result, the needle selection jack 12 is thrust clockwise about the fulcrum 12*a* as the center, and the raising cam butt 14 of the needle selection jack 12 cannot engage with the raising cam 15. Therefore, the needle selection jack 12 is not thrust upward by the raising cam 15, and accordingly the working needle 2 is not thrust upward.

When the piezoelectric body 7 is curved as shown in FIG. 4C, the finger 9 at its tip does not hit the needle selection butt 13 of the needle selection jack 12 which moves circularly together with the knitting cylinder 1. Hence, the needle selection jack 12 remains in the vertical direction, and accordingly the raising cam butt 14 at the lower end of the needle selection jack 12 engages with the raising cam 15. Therefore, the needle selection jack 12 is thrust upward along the inclined surface of the raising cam 15, and accordingly the working needle 2 is also thrust upward.

A member indicated by reference numeral 25 in FIGS. 4B and 4C is a finger pivot stopper formed by part of the frame of the needle selector. When the position of the member 25 is appropriately determined, the finger 9 engages with the needle selection butt 13 reliably, so the finger 9 is prevented from drifting over contact with the needle selection butt 13.

In this manner, selective engagement of the needle selection butt 13 of the needle selection jack 12 with the finger 9 at the tip of the piezoelectric body 7 enables the working needle 2 to move upward freely as desired and thereby enables a knit fabric of any desired knit texture to be knit.

FIG. 5 shows the relationship between the piezoelectric body 7 and finger 9 of this piezoelectric needle selector 3.

As shown in FIG. 5, the finger 9 is arranged to be movable relative to the piezoelectric body 7 having a bimorph piezoelectric element. Power is applied to the piezoelectric body 7 to actuate the finger 9. This motion of the finger 9 causes the working needles of the knitting machine to be selected (more specifically, via the needle selection jack 12), and knitting of a fabric with a predetermined knit texture is made possible. The rear end of the piezoelectric body 7 is movably supported via a spherical body, i.e., a rotary body 20, by a support 21 or a concave part 22 of a housing. The tip of the piezoelectric body 7 is movably linked via a rotary body 16 into a U-shaped groove 17 (to be referred to as a slit 17 hereinafter) at the rear end of the finger 9. The piezoelectric body 7 is arranged with its predetermined position between the rear end and the tip of the piezoelectric body 7 being pinched by a rotary body 23 rotatably fitted to a support 24 or the housing.

As shown in FIG. 5, the finger 9 is supported at its intermediate portion 9*b* by a support 10*b* through a pin 18. Hence, when the piezoelectric body 7 flexes, its motion vertically moves a rear end (piezoelectric body engaging portion) 9*a* of the finger 9. As a result, the finger 9 swings about the pin 18, serving as the pivot support point of the finger 9, as the center, so a bar-shaped portion 9C of the finger 9 projecting through an opening 11 of a support 10*a* swings, and consequently a tip 9*d* moves vertically. The vertical motion of the tip 9*d* causes the rising motion of the working needle 2 described above to be selected.

FIG. 6A is a side view of a conventionally known finger 9, and FIG. 6B is a front view of the same. As shown in FIGS. 6A and 6B, the finger 9 is comprised of a bar-shaped thin elongated member 9*c* extending from a butt abutting surface 9*d* at its tip to reach a central portion 9*b* having a pivot support point 18*a*, and a piezoelectric body engaging portion 9*a* extending from the central portion 9*b* in the other direction. The pivot support point 18*a* is on a longitudinal axis $9X_1$ of the bar-like thin elongated member. The piezoelectric body engaging portion 9*a* has a slit 17 to accommodate a curved motion end 16 of the piezoelectric body.

As shown in FIGS. 6A and 6B, the conventionally known finger 9 is formed of a material, integral from its butt abutting surface 9*d* on the knitting cylinder-side tip to the piezoelectric body engaging portion 9*a* of the needle selector.

The shape, size, and the like of the finger 9, however, change depending on the type of the knitting machine, the type of the needle selector, and the knit texture of the fabric to be knitted by this knitting machine. The manufacturer of the needle selector for the knitting machine copes with this situation by preparing very many types of fingers in stock.

In view of this, it has been discussed to form a predetermined finger in the following manner. The operatively downstream portions (to be referred to as finger members in the following description) of fingers which have butt abutting surfaces engageable with the needle selection jacks of the knitting cylinder and the operatively upstream portions (to be referred to as finger holding members in the following description) of the fingers which have the piezoelectric body engaging portions for the needle selector are fabricated by separate manufacturing steps, and are kept in stock. A finger holding member and finger member are appropriately selected and combined in accordance with the type of the knitting machine in which the finger is to be used, and with the knit texture of the target fabric, thus forming the predetermined finger. This can greatly reduce the number of the types of fingers to be kept in stock.

A finger (to be referred to as a module finger hereinafter) which is formed by combining a finger holding member and finger member to match the object is recently known. An example of the module finger will be described hereinafter with reference to FIGS. 7A and 7B showing perspective views.

A module finger 30*a* shown in FIG. 7A is comprised of a finger member 31*a* and finger holding member 40*a*. The finger member 31*a* is comprised of a butt abutting portion 33*a* having a butt abutting surface 32*a* at its tip, and a support 34*a* extending like a bar from the butt abutting portion 33*a*. The finger holding member 40*a* has a metal plate slit 44*a* at its lower part to form a piezoelectric body engaging portion 45*a*. A connecting plate 46 is connected to the upper side of the slit 44*a*.

The finger member 31*a* and finger holding member 40*a* of the module finger 30*a* shown in FIG. 7A are connected using a synthetic resin after the lower part of the support 34*a* of the finger member 31*a* and the connecting plate 46 above the finger holding member 40*a* are manually arranged to oppose each other. Namely, a connecting portion 51 is formed from the synthetic resin.

The module finger 30*a* obtained with this method cannot be used for high-speed rotation, since the positional relationship between the butt abutting surface 32*a* and piezoelectric body engaging portion 45*a* is low. Furthermore, the complicated manual operation using the synthetic resin increases the cost.

A module finger 30*b* shown in FIG. 7B is comprised of a metal finger member 31*b* substantially identical with the finger member 31*a* shown in FIG. 7A, and a synthetic resin finger holding member 40*b*. The module finger shown in FIG. 7B is manufactured in the following manner. More specifically, first, the finger member 31*b* is manufactured with high precision by using a metal material, and is kept in stock. When fabricating a specific module finger 30*b*, a finger member 31*b* with a structure suitable for the knit texture of the fabric is selected. A mold corresponding to the structure of the target finger holding member 40*b* is loaded in an injection molder, and the finger member 31*b* is arranged at a predetermined position in the mold of the injection molder. Then, a synthetic resin is injected.

The module finger 30*b* shown in FIG. 7B, which is obtained in accordance with the above method, has excellent size precision. Regarding the manufacture of the module finger 30*b*, the expensive injection molder must be operated by a skilled operator. This increases the cost of the obtained module finger.

Although a demand for a module finger with which the stock of the fingers can be decreased and which can be manufactured to meet the situation has arisen, such a module finger is substantially difficult to become popular.

It is an object of the present invention to solve the problems of the conventionally known module finger and to provide a new module finger with which fingers that need to have various types of shapes can be supplied quickly as required at a low cost.

DISCLOSURE OF INVENTION

In order to achieve the above object, a needle selector for a knitting machine according to the present invention has the following arrangement.

More specifically, there is provided a needle selector for a knitting machine, in which a plurality of needle selection jacks each having at least one butt projecting therefrom are swingably fitted in a plurality of vertical grooves in an outer surface of a knitting cylinder such that working needles in contact with the jacks move vertically, characterized in that the needle selector comprises a module finger for selectively engaging with the needle selection jacks of the knitting machine so as to swing the needle selection jacks, and a driving member for pivoting the module finger on the basis of a predetermined knitting procedure, the module finger having a finger member having a butt abutting portion with a butt abutting surface at a tip thereof, and a support extending from the butt abutting portion, and a finger holding member having a connecting portion, at one end thereof, where part of the support of the finger member is mounted so the finger member can be positioned, an engaging portion, at the other end thereof, to be engageable with the driving member of the needle selector for the knitting machine, and a pivot support arranged between the two ends to provide a module finger pivot support point, and the finger member and said finger holding member being combined to each other so that a positioning state obtained by mounting part of the support of the finger member on the connecting portion of the finger holding member is maintained.

A needle selection module finger according to the present invention for achieving the above object has the following arrangement.

More specifically, there is provided a needle selection module finger for a needle selector for a knitting machine, which comprises a finger member and a finger holding member, wherein the finger member has a butt abutting portion with a butt abutting surface at a tip thereof, and a support extending from the butt abutting portion, the finger holding member has a connecting portion, at one end thereof, where part of the support of the finger member is mounted so the finger member can be positioned, and an engaging portion, at the other end thereof, to be engageable with a driving member of the needle selector for the knitting machine, and the module finger further comprises combining means for combining the finger member and the finger holding member to each other so that a positioning state obtained by mounting part of the support of the finger member on the connecting portion of the finger holding member is maintained.

Furthermore, a method of manufacturing a needle selection module finger according to the present invention for achieving the above object comprises the steps of manufacturing a finger member having a butt abutting portion with a butt abutting surface at a tip thereof, and a support extending from the butt abutting portion, manufacturing a finger holding member having a connecting portion, at one end thereof, where part of the support of the finger member is mounted so the finger member can be positioned, and an engaging portion, at the other end thereof, to be engageable with a driving member of a needle selector for a knitting machine, and positioning the finger member and the finger holding member by mounting part of the support of the finger member on the connecting portion of the finger holding member, and combining the finger member and the finger holding member such that a positioning state thereof is maintained.

The needle selection module finger having the above arrangements according to the present invention can be used in various types of needle selectors for a knitting machine.

BEST MODE FOR CARRYING OUT THE INVENTION

The present invention will be described in detail with reference to accompanying drawings showing an embodiment of the present invention.

Figure 1:
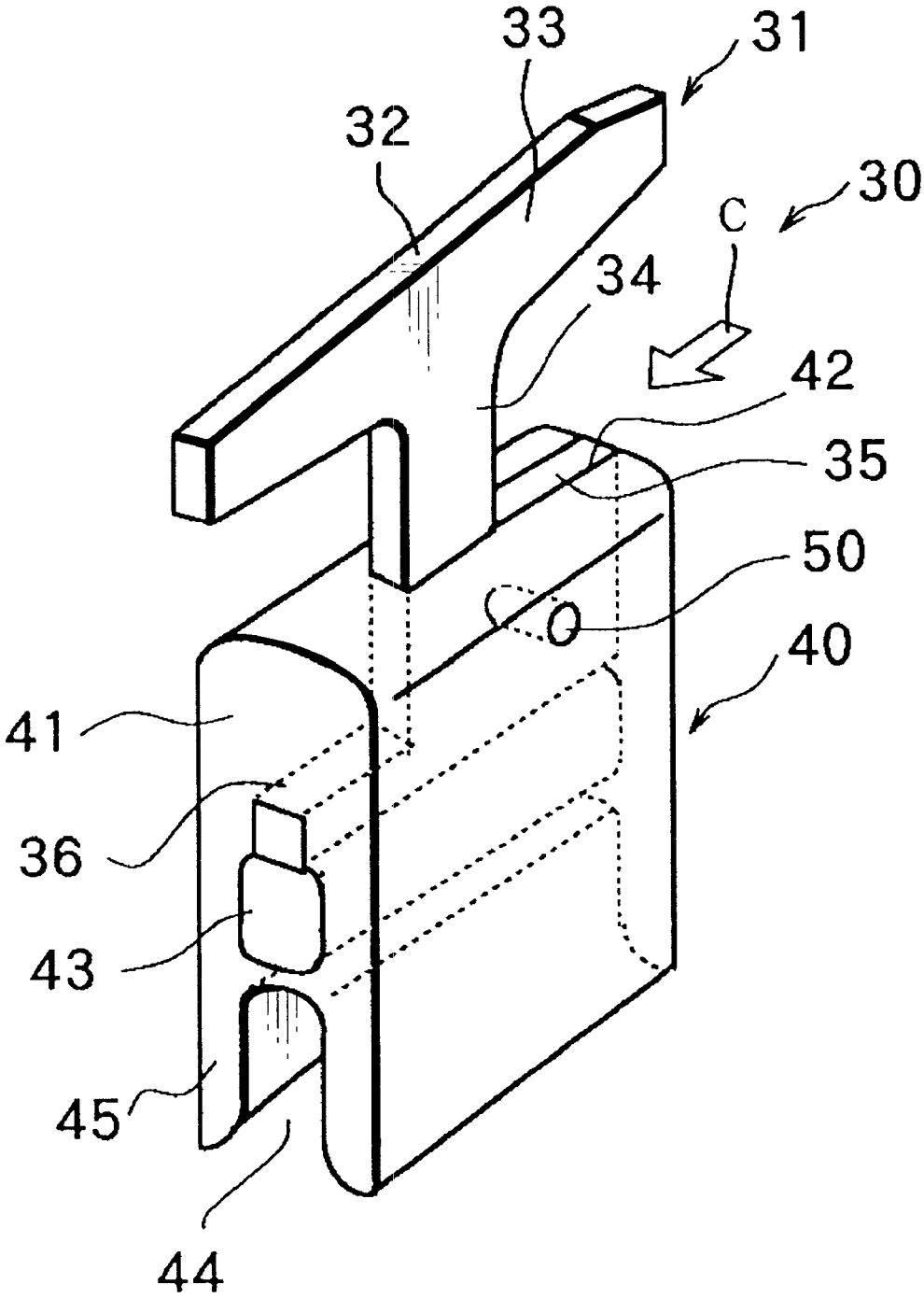
FIG. 1 is a perspective view showing an example of a module finger used in a needle selector for a knitting machine according to an embodiment of the present invention.

FIG. 1 shows in a perspective view showing an example of a module finger used in a needle selector for a knitting machine according to this embodiment. As shown in FIG. 1, a module finger 30 of this embodiment is comprised of a finger member 31 and finger holding member 40.

Figure 2B:
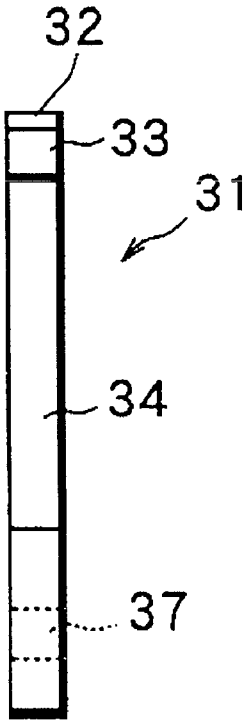
FIG. 2B is a side view of the finger member 31 for the module finger shown in FIG. 2A.
Figure 2A:
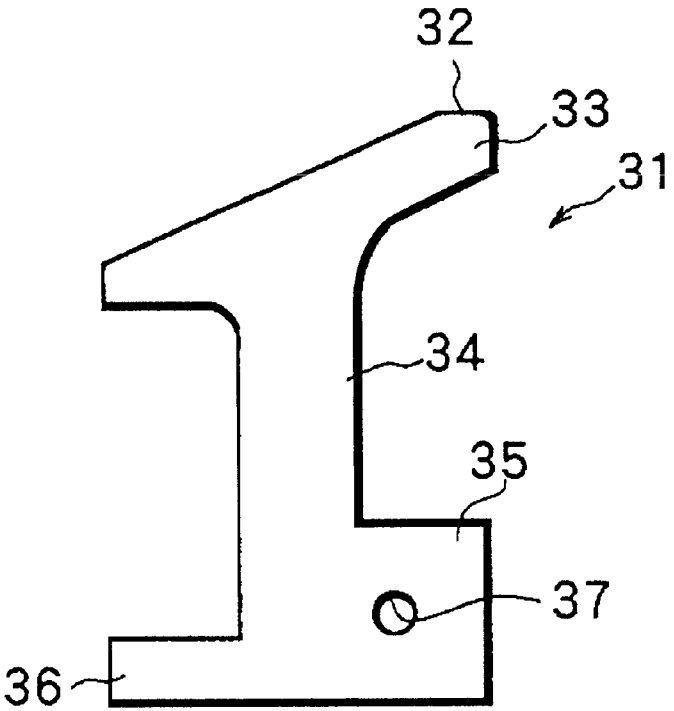
FIG. 2A is a front view showing an example of a finger member 31 for the module finger shown in FIG. 1.
Figure 3B:
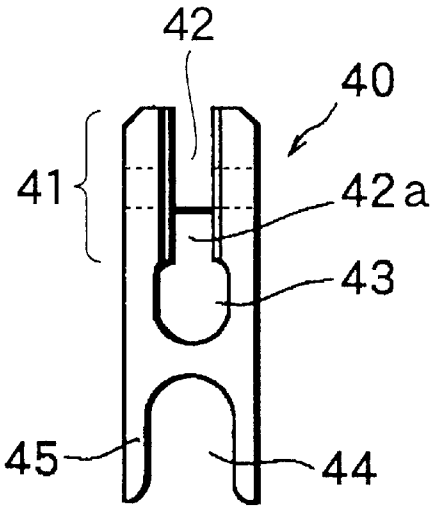
FIG. 3B is a side view of the finger holding member 40 shown in FIG. 3A.
Figure 3C:
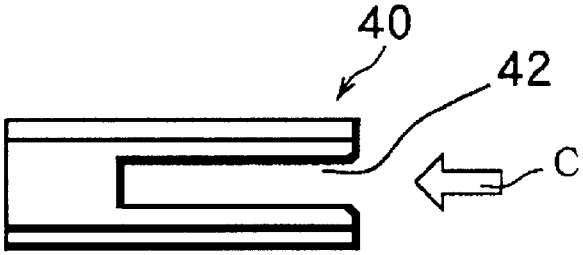
FIG. 3C is a plan view of the finger holding member 40 shown in FIG. 3A.
Figure 3A:
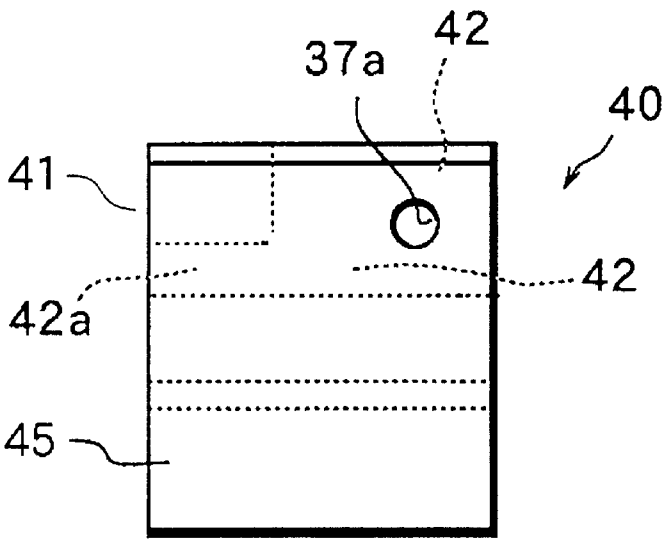
FIG. 3A is a front view showing an example of a finger holding member 40 for the module finger shown in FIG. 1.
Figure 4A:
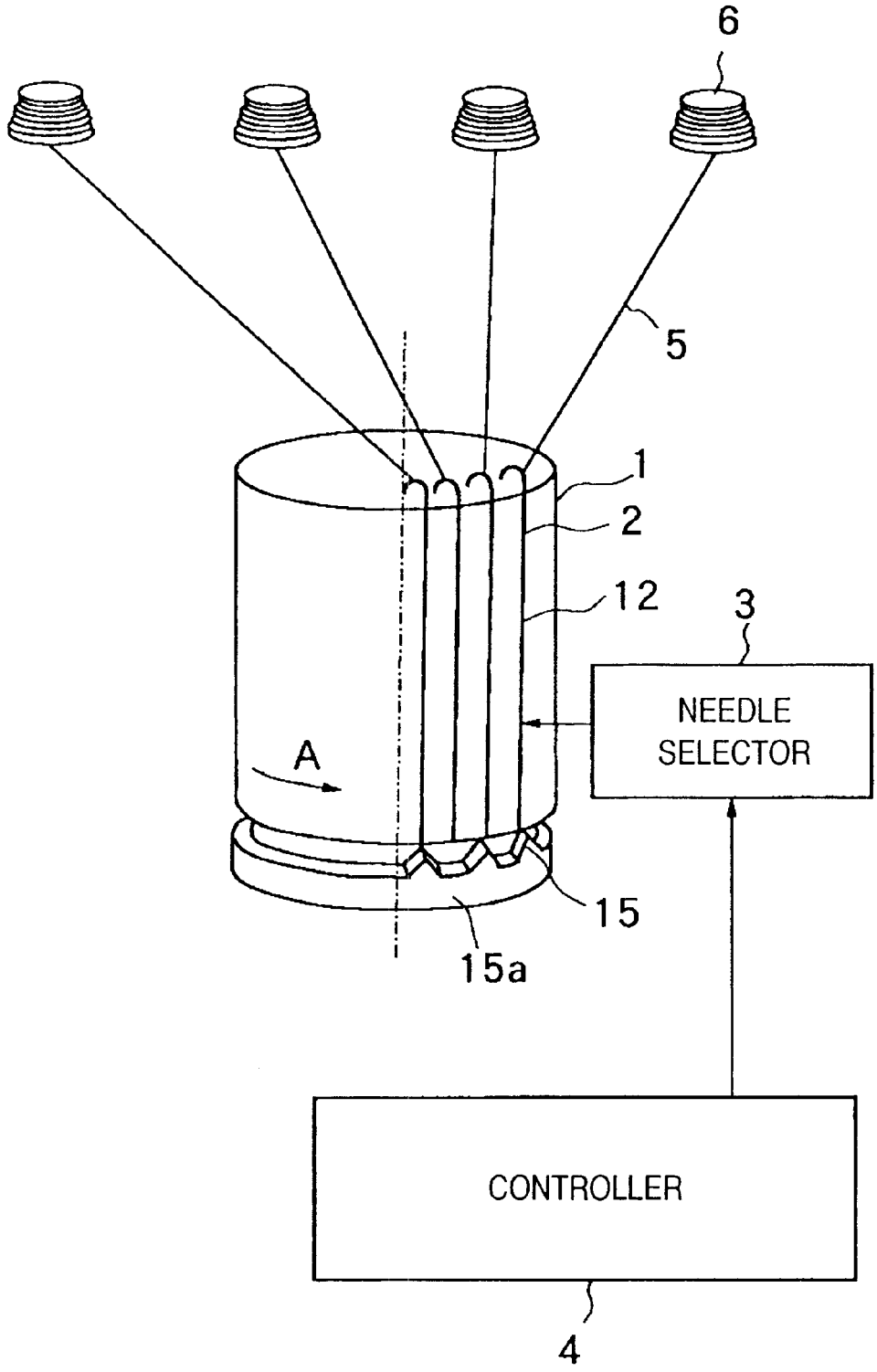
FIG. 4A is a schematic perspective view of an entire knitting machine to explain the knitting function of the knitting machine.
Figure 4B:
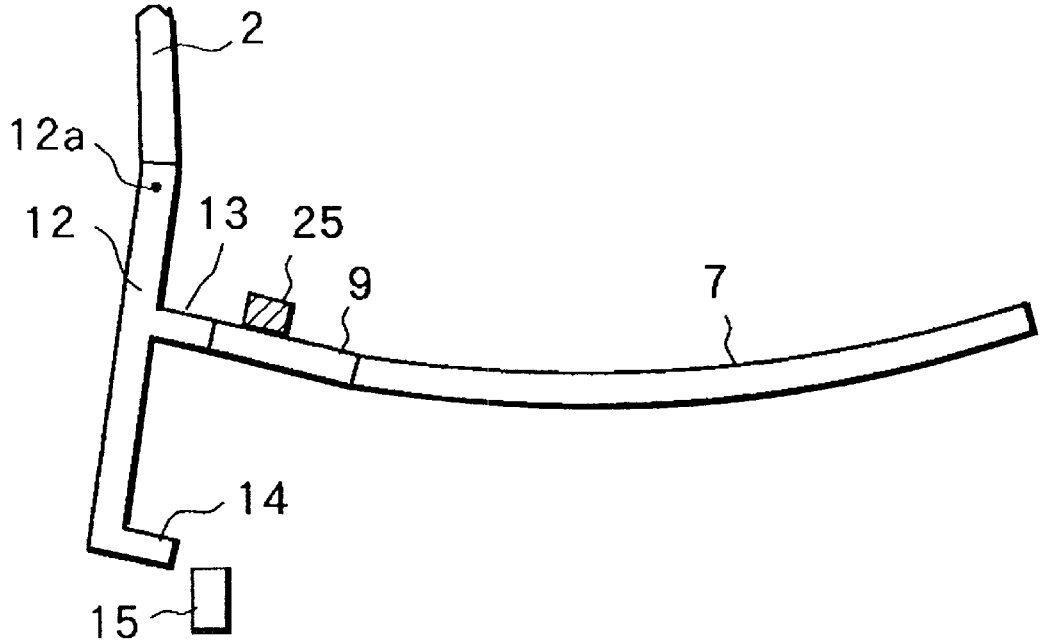
FIG. 4B is a view for explaining the knitting function of the knitting machine in a state wherein the finger of the needle selector engages with the needle selection pad of the needle selection jack.
Figure 4C:
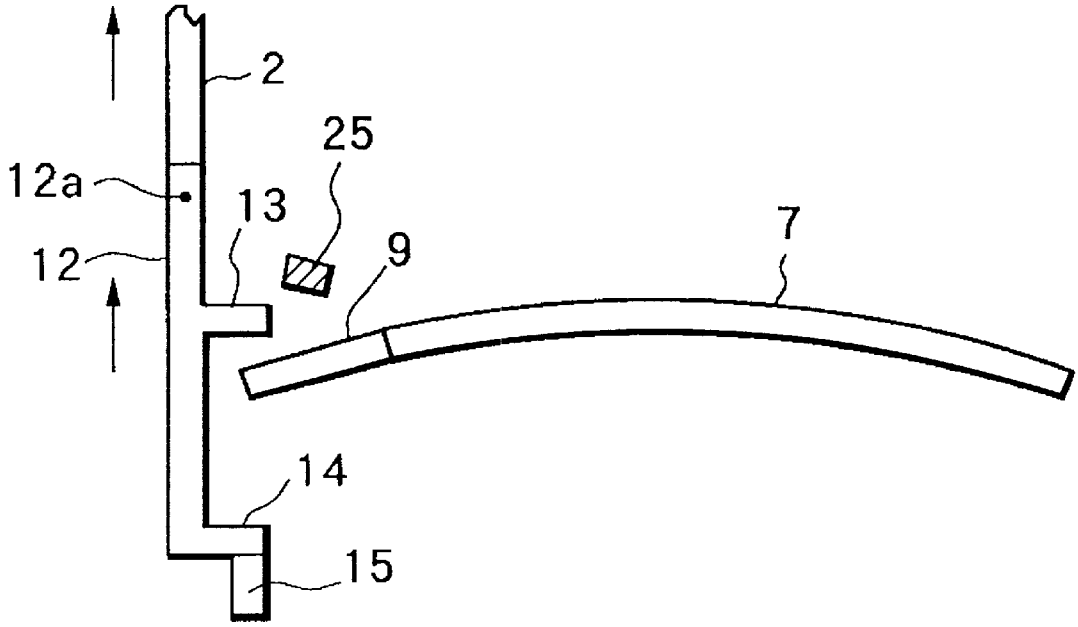
FIG. 4C is a view for explaining the knitting function of the knitting machine in a state wherein the finger of the needle selector does not engage with the needle selection pad of the needle selection jack.

FIGS. 2A and 2B are views showing an example of the finger member 31, in which FIG. 2A is a front view, and FIG. 2B is a side view. FIGS. 3A to 3C are views showing an example of the finger holding member 40, in which FIG. 3A is a front view, FIG. 3B is a side view of the finger member of FIG. 3A, and FIG. 3C is a plan view.

As shown in FIG. 1 and FIGS. 2A and 2B, the finger member 31 is comprised of a butt abutting portion 33 having a butt abutting surface 32 at its tip, and a support 34 projecting like a bar from the butt abutting portion 33. The support 34 has at its lower part a projection 35 extending to the right and an inserting projection 36 extending to the left in the example of FIG. 2A. The projection 35 has a hole 37 corresponding to a hole 37*a* of the finger holding member 40. The finger member 31 is formed of a flat plate with a uniform thickness, as shown in the side view of FIG. 2B.

As shown in FIG. 1 and FIGS. 3A to 3C, the finger holding member 40 is formed of a plastic main body 41 fabricated with an injection molding. A connecting portion 41 to be connected to the finger member 31 is formed at the upper part (the finger member 31 side) of the finger holding member 40. A piezoelectric body engaging portion 45 to engage with a piezoelectric body 7 is formed at the lower part of the finger holding member 40 on the opposite side to the connecting portion 41. The connecting portion 41 has a concave part 42 to accommodate part of the support 34 of the finger member 31 described above. An insertion type concave part 42*a* where the inserting projection 36 of the finger member 31 is to be inserted is formed on the left side of the concave part 42. The projection 35 of the finger member 31 is to be accommodated in the upper right portion of the concave part 42. When the inserting projection 36 of the finger member 31 is fitted in the insertion type concave part 42*a* of the finger holding member 40, the two members 31 and 40 are positioned relative to each other. With the two members 31 and 40 being combined in this manner, the finger holding member 40 has the hole 37*a* at a position corresponding to the hole 37 of the finger member.

The finger member 31 and finger holding member 40 having the structures described above are assembled together by inserting the finger member 31 toward the insertion type concave part 42*a* of the finger holding member 40 in a direction indicated by an arrow C in FIGS. 1 and 3C. At this time, when the inserting projection 36 of the finger member 31 is inserted in the insertion type concave part 42*a* of the finger holding member 40, the two members are positioned.

In this manner, when the two members 31 and 40 are combined, the hole 37 of the finger member 31 and the hole 37*a* of the finger holding member 40 are aligned on one straight line. When a pin-shaped member 50 is inserted through the holes 37 and 37*a*, the two members 31 and 40 are connected integrally. The pin-shaped member also helps in positioning the two members 31 and 40.

Figure 5:
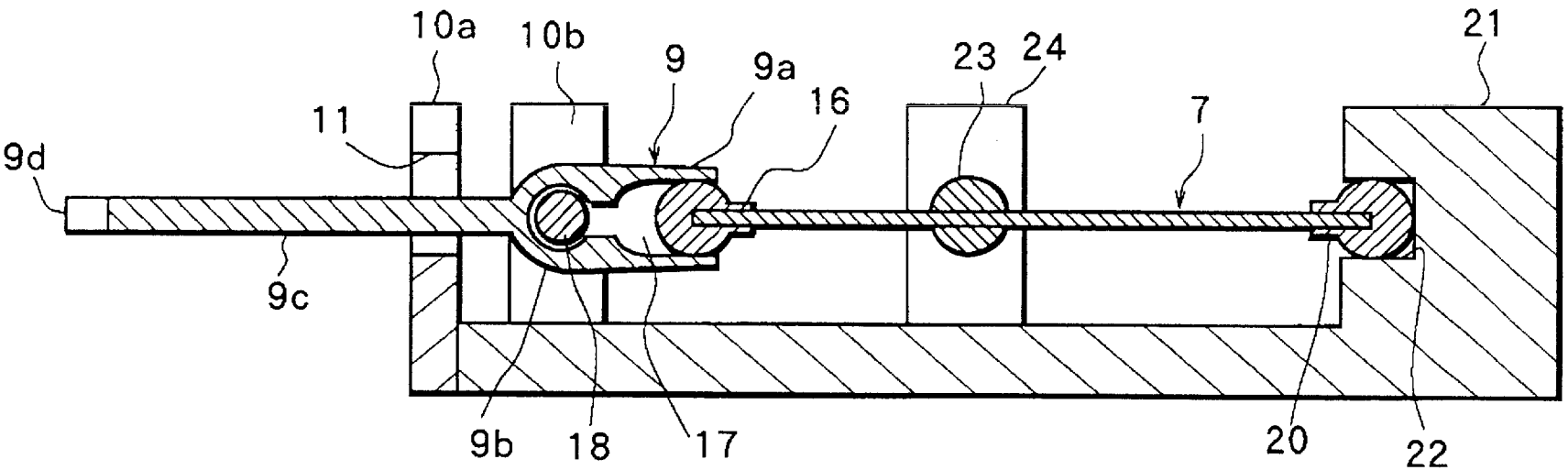
FIG. 5 is a side sectional view showing the operational relationship between the piezoelectric body and the finger in the needle selector for the knitting machine.
Figure 6A:
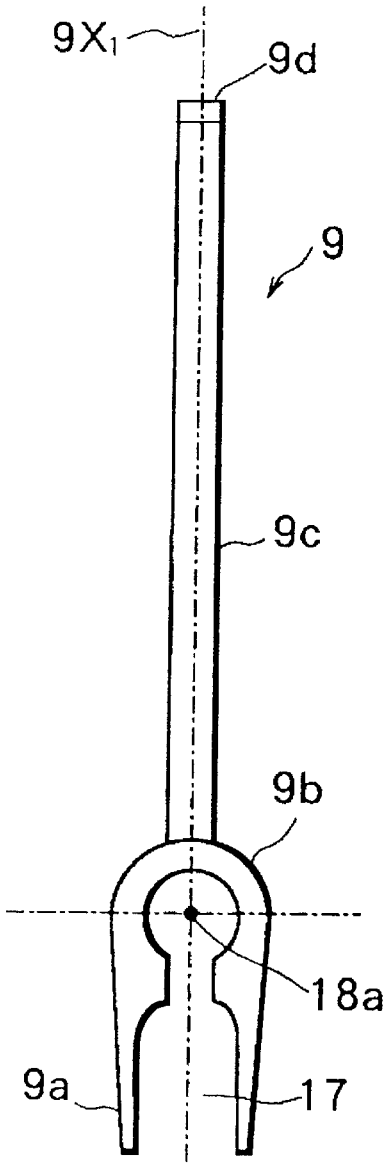
PRIOR ART FIG. 6A
FIG. 6A is a side view showing an example of a conventionally known finger.
Figure 6B:
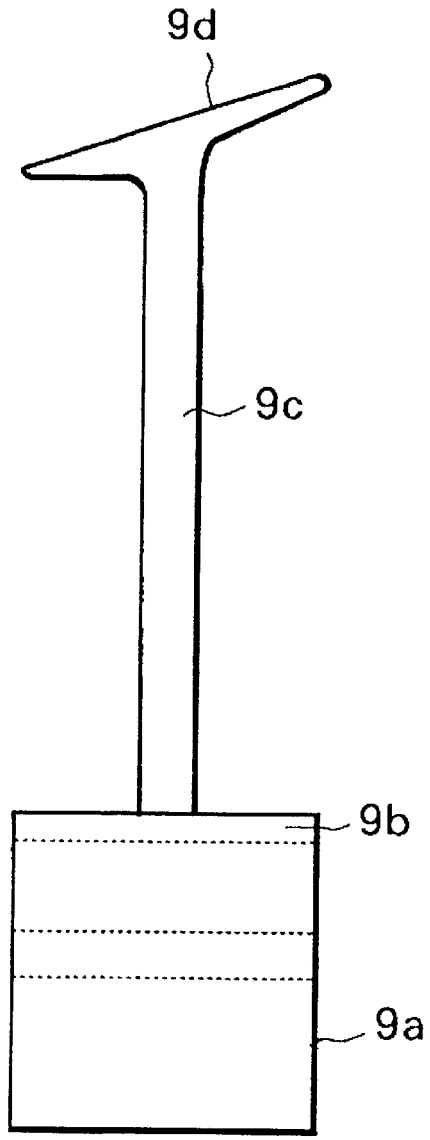
FIG. 6B is a front view of the finger of FIG. 6A.
Figure 7A:
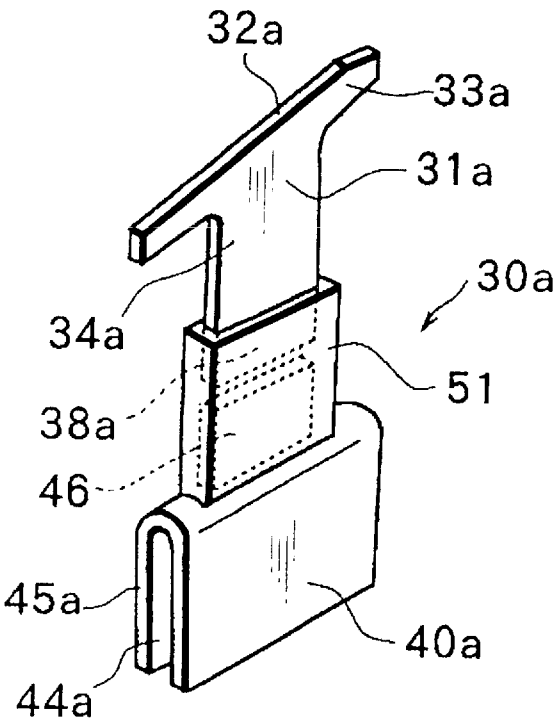
PRIOR ART FIG. 7A
FIG. 7A is a view showing a conventional module finger formed by combining two members, i.e., a finger member and a finger holding member in a case wherein the two members are connected to each other with a resin.
Figure 7B:
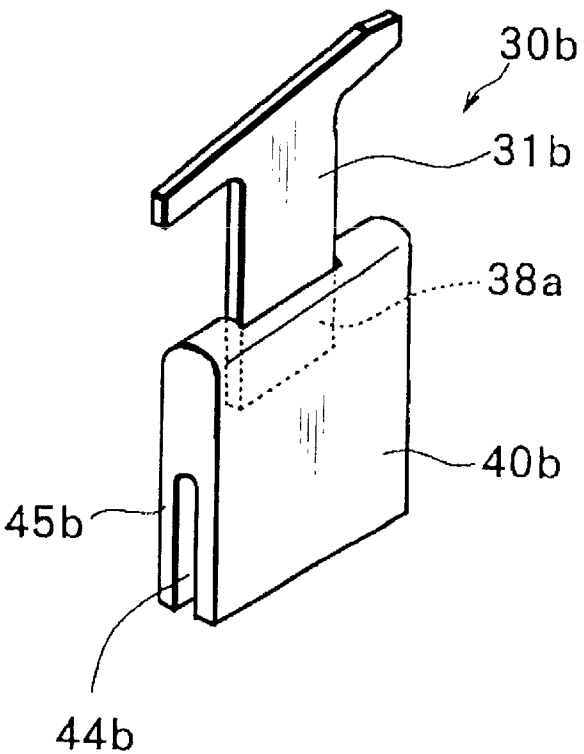
FIG. 7B is a view showing a conventional module finger formed by combining two members, i.e., a finger member and a finger holding member in a case wherein a module finger is obtained by burying a metal finger member in a resin finger holding member by using an injection molder.

As shown in FIGS. 1 and 3B, a pivot support 43 is formed between the connecting portion 41 and piezoelectric body engaging portion 45. The pivot support 43 is a fulcrum portion where a pin 18 (see FIG. 5) is inserted so the module finger 30 swings. The piezoelectric body engaging portion 45 has a slit 44 as shown in FIG. 3C. The slit 44 is a space where a tip 16 of the piezoelectric body 7 on the module finger 30 side slides along with the swing motion of the piezoelectric body 7. The piezoelectric body engaging portion 45 is a portion which engages with the tip 16 of the piezoelectric body 7. These portions are conventionally known structures in the arrangement of the finger, as described in FIG. 5, and a detailed description thereof will accordingly be omitted.

The module finger shown in FIG. 1, FIGS. 2A and 2B, and FIGS. 3A to 3C is merely an example of the module finger of the present invention, and can be modified in various manners. For example, in the module finger 30 shown in FIG. 1, the finger member 31 and finger holding member 40 may be integrally combined to each other without using the pin-shaped member 50 but with an adhesive or by ultrasonic welding. In this case, the two members are positioned by inserting the inserting projection 36 of the finger actuating member 31 into the insertion type concave part 42*a* of the finger holding member 40.

As described above, the concave part 42 and insertion type concave part 42*a* for accommodating at least some lower part (35, 36) of the support 34 of the module finger 30 are formed in one end of the finger holding member 40. The respective members have the holes 37 and 37*a* so as to form a hole extending through the support 34 and connecting portion 41 when the support is inserted and positioned in these concave parts. As shown in FIG. 1, with the finger member 31 and finger holding member 40 being positioned, the pin-shaped member 50 is inserted in the through hole formed by the holes 37 and 37*a*, so that the finger member 31 and finger holding member 40 are integrally connected to each other. With this arrangement, the positional relationship between the butt abutting portion 33 of the finger member 31 and the piezoelectric body engaging portion 45 of the finger holding member 40 (or the positional relationship between the butt abutting portion 33 and the pivot support 43 of the finger holding member 40) is determined by inserting the supports (35, 36) of the module finger 30 in the concave part 42 and insertion type concave part 42*a* of the finger holding member 40. Furthermore, when the pin-shaped member 50 is arranged in the holes (37*a*, 37) extending through the connecting portion 41 of the finger holding member 40 and the projection 35 of the finger member 31, the finger member 31 and finger holding member 40 can be positioned more reliably, and the finger member 31 and finger holding member 40 are integrally connected to each other.

Positioning of the finger holding member 40 and finger member 31 by means of the concave parts (42, 42*a*) and the supports (35, 36) is not limited to the above embodiment, but can be modified in various manners. In fine, this positioning is achieved by forming at least one portion where part of the finger member and part of the finger holding member are combined to each other face to face, such that the positional relationship between the butt abutting surface of the finger member and the piezoelectric body engaging portion (or pivot support) of the finger holding member relative to each other is defined accurately.

In the manufacture of the above finger module, a plurality of finger members 31 are manufactured and kept in stock for the respective types so as to cope with the knit textures of various types of fabrics. A plurality of types of finger holding members 40 are manufactured and kept in stock in accordance with the specification of the needle selector where the finger module is to be built. Finger members are selected in accordance with the target knit texture, and finger holding members are selected in accordance with the needle selector where they are to be built. The selected finger members and finger holding members are assembled, combined, and integrated as described with reference to FIG. 1, FIGS. 2A and 2B, and FIGS. 3A to 3C. As a result, various types of finger modules can be provided.

As the knitting cylinder rotates, the butt abutting surfaces at the tips of the finger members come into intermittent contact with the butts of a large number of needle selection jacks at a high speed. Accordingly, the finger members are preferably made of a metal having high impact resistance and high wear resistance.

The finger holding member engages with one end of the piezoelectric body by its piezoelectric body engaging portion, and receives the swing motion of the piezoelectric body. At this time, since the finger holding member and piezoelectric body engage with each other in continuous contact, the finger holding member requires high shape precision, but does not require high impact resistance or high wear resistance unlike the finger member. Accordingly, a relatively inexpensive resin material, e.g., a plastic material, having high workability is preferably used to form the finger holding member.

As described above, the module finger according to the present invention is formed by fabricating a finger member and finger holding member, which have different performances required in the manufacture and operation, using separate materials, and by combining them. Consequently, various many types of fingers can be formed by combination of a comparatively small number of types of finger members and finger holding members. Since a simple and reliable integral connecting method is employed, a new demand for a high quality finger can be coped with quickly at a relatively low cost.

What is claimed is:

1. A needle selector for a knitting machine, wherein a plurality of needle selection jacks of the knitting machine each comprise at least one butt projecting therefrom and are swingably fitted in a plurality of vertical grooves in an outer surface of a knitting cylinder such that working needles in contact with said jacks move vertically, said needle selector comprising:

a module finger for selectively engaging with the needle selection jacks of the knitting machine so as to swing the needle selection jacks, and a driving member for pivoting said module finger based on a predetermined knitting procedure, wherein said module finger comprises:

a finger member having a butt abutting portion with a butt abutting surface at a tip thereof, and a support extending from the butt abutting portion, and a finger holding member including: (i) a connecting portion at a first end thereof, said connecting portion having a concave part where part of the support of said finger member is mounted to enable positioning of the finger member, (ii) an engaging portion at a second end thereof which is engageable with the driving member of the needle selector for the knitting machine, and (iii) a pivot support arranged between the first and second ends to provide a pivot support point for said module finger, wherein an inserting projection is formed at a portion of the support of said finger member, wherein an insertion type concave part having an inner surface to support the inserting projection of said finger member is formed at a portion of the concave part of said finger holding member, and wherein said finger member and said finger holding member are positioned and combined by inserting the inserting projection into the insertion type concave part.

2. The needle selector for the knitting machine according to claim 1, wherein the driving member comprises a piezoelectric body.

3. The needle selection module finger according to claim 1, wherein a hole extends through the concave part of said finger holding member and the support of said finger member mounted in the concave part, and a pin-shaped member is arranged in the hole.

4. The needle selection module finger according to claim 1, wherein said finger member comprises a metal.

5. The needle selection module finger according to claim 1, wherein said finger member comprises a resin.

6. A method of manufacturing a needle selection module finger, comprising:

manufacturing a finger member having: (i) a butt abutting portion with a butt abutting surface at a tip thereof, and (ii) a support that extends from the butt abutting portion and that has an inserting projection, manufacturing a finger holding member having: (i) a connecting portion at a first end thereof where an insertion type concave part having an inner surface to support the inserting projection is formed, and (ii) an engaging portion at a second end thereof which is engageable with a driving member of a needle selector for a knitting machine, and positioning and combining the finger member and the finger holding member by inserting the inserting projection of the support of the finger member in the insertion type concave part of the connecting portion of the finger holding member.

7. The method of manufacturing the needle selection module finger according to claim 6, wherein:

finger members made of a plurality of types of metals are manufactured and stored to correspond to a plurality of types of knit patterns, and one of said finger members is selected in accordance with a knit pattern for combination with the finger holding member.

8. The method of manufacturing the needle selection module finger according to claim 6, wherein:

a plurality of types of finger holding members are manufactured and stored in accordance with types of needle selectors with plastic injection molds, and one of said finger holding members is selected in accordance with a type of a knitting machine.

* * * * *